United States Patent [19]

Balboni

[11] 4,162,393

[45] Jul. 24, 1979

[54] ELECTRIC HEATING MATTRESS

[75] Inventor: Allen J. Balboni, Chepachet, R.I.

[73] Assignee: Bel Air Industries Inc., Providence, R.I.

[21] Appl. No.: 925,809

[22] Filed: Jul. 18, 1978

Related U.S. Application Data

[63] Continuation of Ser. No. 786,865, Apr. 12, 1977, abandoned, which is a continuation of Ser. No. 620,548, Oct. 8, 1975, abandoned.

[51] Int. Cl.[2] ..... H05B 3/36

[52] U.S. Cl. ..... 219/217; 5/459; 219/528

[58] Field of Search ..... 219/211, 212, 217, 345, 219/477, 527, 528, 529, 545, 549; 338/210, 212; 5/343, 347, 361 B

[56] References Cited

U.S. PATENT DOCUMENTS

| | | | |
|---|---|---|---|
| 2,052,644 | 9/1936 | Murphy | 219/528 |
| 2,114,396 | 4/1938 | McFarlan et al. | 219/528 |
| 2,688,070 | 8/1954 | Freedlander | 219/528 |
| 2,715,674 | 8/1955 | Abbott et al. | 219/212 |
| 2,735,926 | 2/1956 | Langlois | 219/528 |
| 2,873,352 | 2/1959 | Franco | 219/528 |
| 3,125,663 | 3/1964 | Hoffman | 219/217 |
| 3,172,072 | 3/1965 | Willy | 338/210 |
| 3,380,087 | 4/1968 | Petty et al. | 5/343 |
| 3,423,574 | 1/1969 | Shomphe et al. | 219/528 |
| 3,924,284 | 12/1975 | Nelson | 5/347 |

FOREIGN PATENT DOCUMENTS

| | | | |
|---|---|---|---|
| 233047 | 3/1959 | Australia | 219/217 |
| 459058 | 8/1948 | Canada | 219/217 |
| 62141 | 12/1948 | Netherlands | 219/217 |
| 792671 | 4/1958 | United Kingdom | 5/347 |
| 906265 | 9/1962 | United Kingdom | 5/347 |

*Primary Examiner*—Volodymyr Y. Mayewsky
*Attorney, Agent, or Firm*—Salter & Michaelson

[57] ABSTRACT

An electric mattress and subcombinations characterized by a thick fire-retardant foam rubber pad overlying one or more heating pads with a plurality of separately controllable heating zones.

2 Claims, 7 Drawing Figures

ELECTRIC HEATING MATTRESS

BACKGROUND OF THE INVENTION

This application is a continuation of U.S. application Ser. No. 786,865 filed Apr. 12, 1977, now abandoned, which is a continuation of U.S. application Ser. No. 620,548 filed Oct. 8, 1975, now abandoned.

SUMMARY OF THE INVENTION

The invention provides an electric mattress, and subcombinations thereof, in which a thick, fire-retardant foam pad is provided over one or more electric heating pads. In another aspect, the invention provides such pads in which are provided more than a single separately controllable heating zone. In preferred embodiments for lighter users, as in baby mattresses, the thick pad is at least one-half inch thick, a thinner fire-resistant foam pad is provided beneath the electric heating pad, and there are provided two transversely spaced heating pads, each divided into three longitudinally spaced separately controllable heating zones. In preferred embodiments for heavy people, the thick pad should be at least about one inch thick, to prevent their body's crushing it uncomfortably near a heating pad.

The invention relates to electric mattresses and to subcombinations useful therein.

One electric mattress was disclosed in Westerburgh et al. U.S. Pat. No. 2,606,996, in which a single zone heating element layer was provided beneath a quilted layer.

Important objects of the present invention are to provide for improved heat conservation and distribution, both in the way insulative values ae provided and varied and through provision for separately controlling the quantity of heat provided at different areas of the body.

DESCRIPTION OF THE PREFERRED EMBODIMENT

Figure 1:
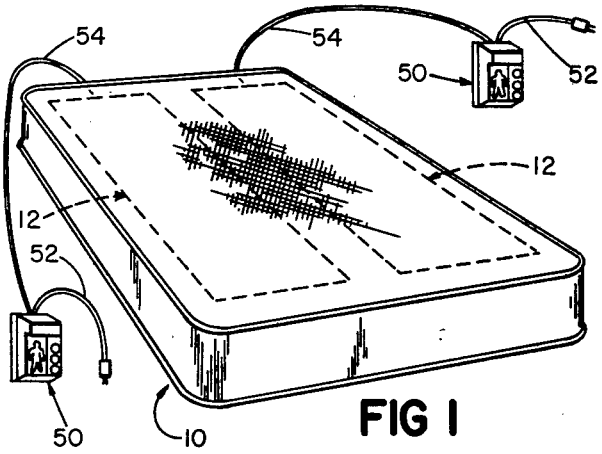
FIG. 1 is a perspective view of a preferred embodiment of a mattress according to the invention.
Figure 2:
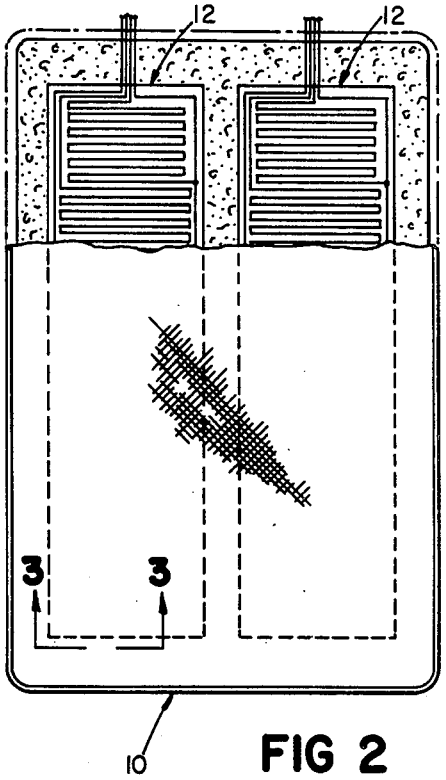
FIG. 2 is a plan view, partially broken away, thereof.

Turning now in more detail to the presently preferred embodiment of the invention, there is shown in FIG. 1 an electric mattress 10 incorporating two mattress heating pads 12, each pad providing three different heating zones.

Figure 4:
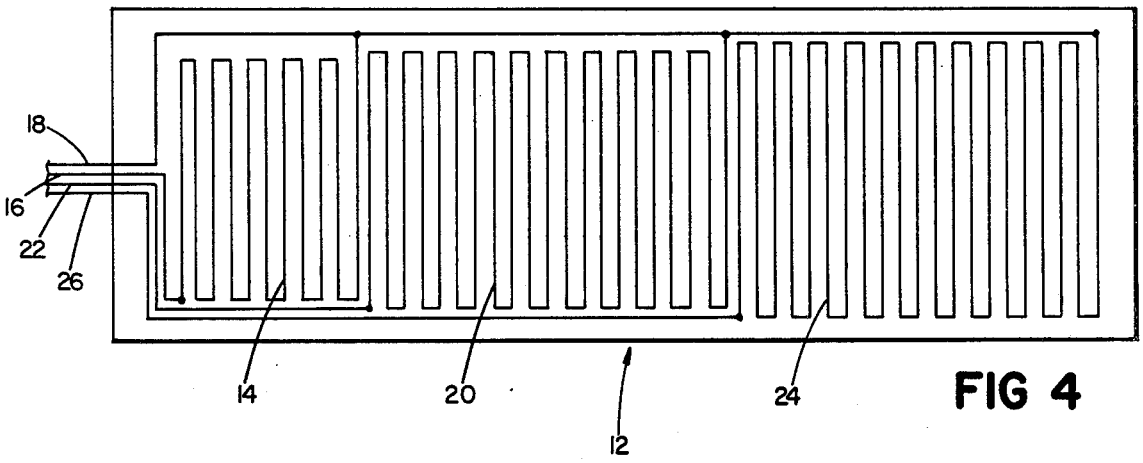
FIG. 4 is a partially broken away plan view, somewhat diagrammatic, of a mattress pad of the preferred embodiment of the invention.

A mattress heating pad 12 is shown in diagrammatic (the wires are not dotted, as they should be for strict accuracy, interalia) view in FIG. 4. A first section 14 of resistance wire is connected between wire 16 and common wire 18. A second, intermediate, section 20 of resistance wire is connected between wire 22 and common wire 18. A third section 24 of resistance wire is connected between wire 26 and common wire 18. The first section is a 30-watt section, while each of the second and third sections is a 60-watt section.

In the 30-watt section, the heating wire is 7.1 mil diameter wire (60% Ni, 16.2% Cr, 23.8% Fe, sold as "Alloy C" by Jelliss Manufacturing Company), wound helically to provide a coil with 10 turns per inch and a diameter over the coil of 34 mils, to provide great flexibility and an overall resistance of 18.75 ohms per foot; longitudinal stability without impairment of flexibility is provided by a 25 mil strand of fiberglass yarn extending coaxially with the coil inside it; each run of coiled wire in this section is 17 inches long (with one-half inch pad border free of wire), and adjacent runs are about one-half inch apart.

In the sixty-watt sections, the resistance wire is similarly coiled (10 coils per inch) about a twenty-five mil fiberglass yarn extending therethrough, and each run again extends 17 inches, although adjacent runs are only about ⅜" apart. However, the wire is 8 mils (22% Ni, 78% Cu, sold by said Jelliss Manufacturing Company as "Alloy 180"), with an as-coiled resistance of 3.7 ohms per foot and a diameter over the coiled wire of 38 mils.

Each mattress pad draws 1.25 amperes when fully actuated at all three zones.

In manufacturing a mattress heating pad as herein described, the four copper wires 16, 18, 22, and 26 are silver-soldered to the resistance wires of sections 14, 20, and 24, respectively. A silicone rubber cord set at its end and the three zones of resistance wires are then placed centrally between two sheets of fiberglass-reinforced uncured silicone rubber, each 10 mils in overall thickness and each having therein a 5-mil thick very open weave layer of woven fiberglass cloth (A.S.T.M. Style 1620), the rubber extending through interstices of the cloth. This sandwich is prevulcanized, then, in a conventional press, at 300° F. and 90 psi for one minute, extra silicone rubber being provided around the soldered connections for protection and insulation. The resultant sandwich is placed between two further layers of material, each extending beyond the initial sandwich ¼" on all sides. These further, outer, layers of material are also of fiberglass-reinforced unvulcanized silicone rubber, but are 23 mils thick, and the tightly woven fiberglass fabric (A.S.T.M. Style 162) carried in them, with the rubber in the interstices thereof, is 18 mils thick. The total sandwich is cured then in the same press for 10 minutes at 300° F. and 90 psi.

This combination thus reinforced, constituted, and laminated, provides great pad durability, flexibility, and freedom from tendency to return to a previously-creased configuration (crease memory).

Figure 5:
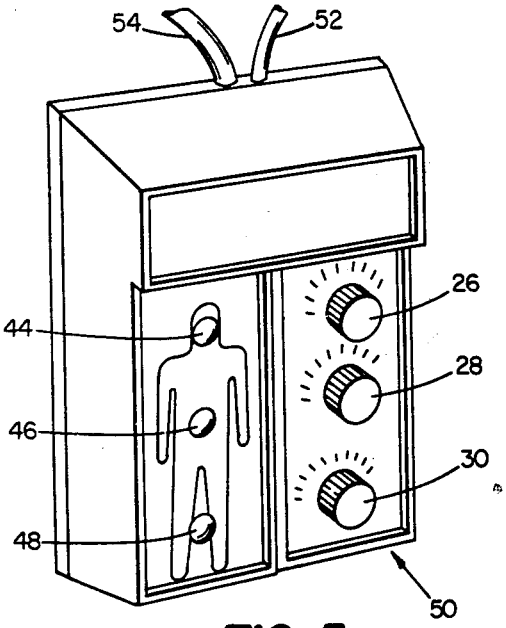
FIG. 5 is an isometric view of a control box for said preferred embodiment.
Figure 6:
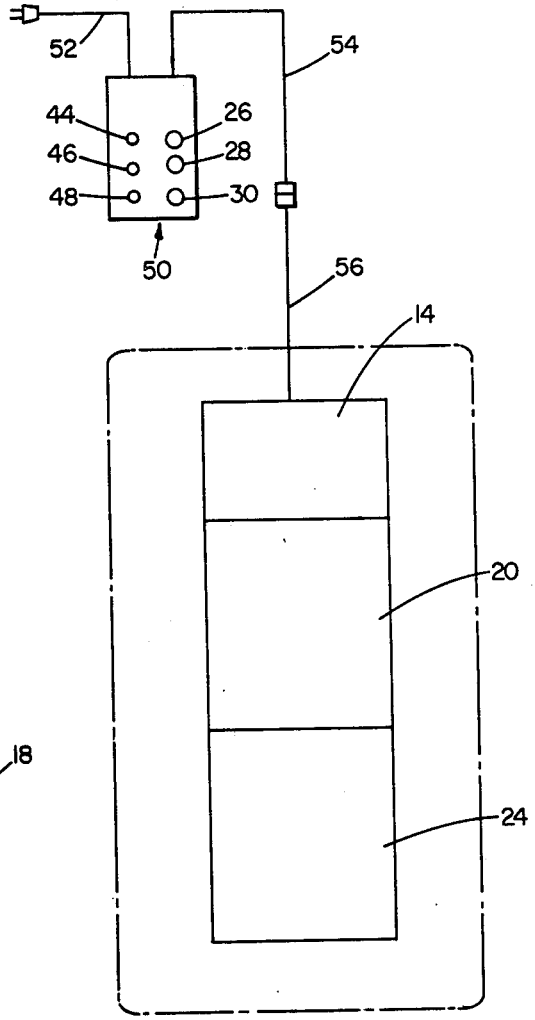
FIG. 6 is a diagrammatic plan view of a mattress according to the invention and carrying only a single heating pad.
Figure 7:
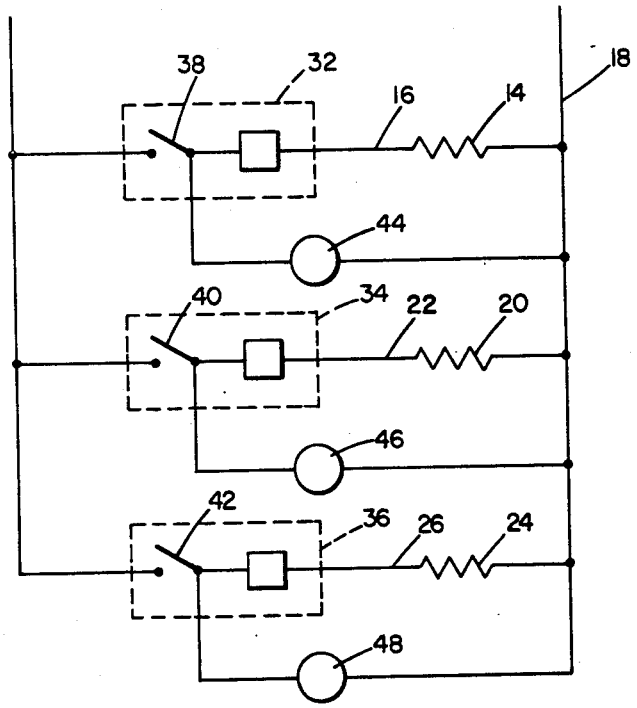
FIG. 7 is a circuit diagram of said embodiment.

Each pad is controlled by one of the knobs 27, 28, 30 (FIG. 5), which respectively operate 200 watt dimmers 32, 34, and 36 (FIG. 7). These dimmers are similar to ordinary light dimmers, except that they provide as soon as turned on at all (switches 38, 40, and 42 closed) a flow of current great enough for meaningful heating, and are sold by Leviton Manufacturing Company, Inc. under Catalog Number 6204-4. When the dimmers are actuated, and switches 38, 40, and 42 thus closed, neon signal lights 44, 46, and 48 (Leecraft Manufacturing Co., Inc.) turn on. Control boxes 50 are made of high impact polystyrene, and polyvinyl butyrate strain relief elements (not shown) secure electrical cords thereto.

Two wire electrical cords 52 and four-wire electrical cords 54 are non-migrating polyvinyl "thermoplastic"

cord sets. Cords 54 are joined at Jones plugs 56, which insure proper continued four wire orientation, to silicone rubber 4-wire cord sets (Marquell, U.L. Style 3132).

The circuitry is shown in FIG. 7, the three wires 16, 22, and 26 being shown connected between dimmers 32, 34, and 36 and heating element sections 14, 20, and 24, respectively, the common wire 18 in each instance completing the circuit.

Figure 3:
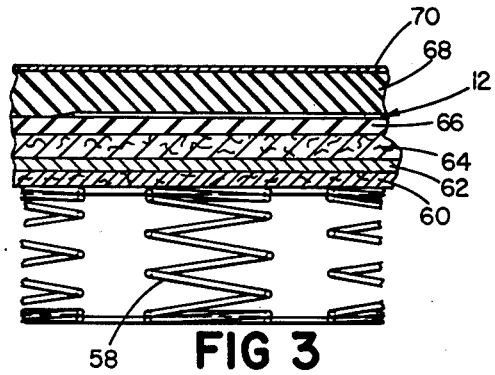
FIG. 3 is a partial sectional view therethrough at 3—3 in FIG. 2.

FIG. 3 shows somewhat diagrammatically the preferred embodiment of mattress. Atop box springs 58 are 6 ounce jute pads 60, 2½ ounce Coirtex pad 62, a layer of 6 pound per batt density cotton batting 64, a ⅜" sheet of fire retardant polyurethane (density 1.8) 66, a one-inch thick layer of fire retardant polyurethane foam (density 2.4) 68, and cover (60% polyester and 40% cotton) 70. Squeezed between foam layers 66 and 68 are heating pads 12 (Dennison clips passing through grommeted ⅛" holes adjacent the four corners of each heating pad hold together as a unit these pads 12 and layers 60, 62, 64, and 66). The bump caused by incoming cord set 56 is placed toward the bottom of the mattress.

The thick upper foam pad has the advantages that it is such a good insulator that even though its surface is hot relative to what is comfortable to the human body, as it is when on and not in direct nearby contact with a human body, upon such contact so little heat flows to cool it down to what is comfortable that its hotness is not really perceptible to the touch. Furthermore, where the body lies compresses the foam and reduces its insulating quality proportionately to body weight, selectively increasing heat flow at the very points where useful, and conserving insulation at points where heat flow is not as useful.

Other embodiments within the spirit of the invention and the scope of the appended claims will occur to those skilled in the art.

What is claimed is:

1. An electric heating mattress, comprising a base layer of foam material, an upper layer of foam material of substantially the same length and width as said base layer and defining an occupant supporting member, and a heating pad interposed between said layers of foam material and occupying less than the full length and width thereof, said heating pad including at least three separate heating zones that are disposed in head-to-foot relation and normally underlie an occupant, wherein a selected portion of the body of said occupant may be heated as required, the upper layer of foam having a cellular construction that without a load applied thereto normally inhibits the transfer of heat therethrough, the cellular foam material from which said upper layer is formed being compressible under the load of an occupant on the upper surface thereof to the extent that transfer of heat is permitted therethrough for increasing the temperature of the portions of the upper layer in contact with said occupant, said heating pad being defined by relatively thin layers of rubberized material between which resistance wires are embedded, said pad as interposed between said foam layers being located more closely adjacent to the upper surface of said mattress than the bottom thereof, wherein heat is more readily transferred through the areas of the upper layer of foam compressed by the occupant to the body of the occupant, means for securing said pad in place between said base and upper layers, means for encasing said base and upper layers with said heating pad therebetween for the location thereof in oriented relation, means electrically connected to said resistance wires and to a source of electricity for supplying current to said resistance wires, and means for controlling the flow of current to said resistance wires for controlling the temperature of said pad and the occupant supporting layer thereover.

2. An electric heating mattress, comprising a base layer of flexible and compressible material, an upper layer of foam material of substantially the same length and width as said base layer and defining an occupant supporting member, and a heating pad interposed between said base layer and said upper layer of foam material and including a heating area that occupies less than the full length and width of said layers, said heating area including a plurality of separate heating zones that are disposed in head-to-foot relation and normally underlie an occupant, wherein a selected portion of the body of said occupant may be heated as desired, the upper layer of foam having a cellular construction that without a load applied thereto normally inhibits the transfer of heat therethrough, the cellular foam material from which said upper layer is formed being compressible under the load of an occupant on the upper surface thereof to the extent that transfer of heat is permitted therethrough for increasing the temperature of the portions of the upper layer in contact with said occupant, said heating pad being defined by at least one layer of flexible material to which electrically insulated resistance wires are secured, said resistance wires defining the heating area, said pad as interposed between said foam layer and said base layer being located more closely adjacent to the upper surface of said mattress than the bottom thereof, wherein heat is more readily transferred through the areas of the upper layer of foam compressed by the occupant to the body of the occupant, means for securing said pad in place between said base and upper layers, means for encasing said base and upper layers with said heating pad therebetween for the location thereof in oriented relation, means electrically connected to said resistance wires and to a source of electricity for supplying current to said resistance wires in said heating zones, and means for controlling the flow of current to said resistance wires in said heating zones for controlling the temperature of said heating zones and the occupant supporting layer located thereover.

* * * * *